United States Patent [19]

Greeley et al.

[11] 4,057,708

[45] Nov. 8, 1977

[54] MINIMUM MISS DISTANCE VECTOR MEASURING SYSTEM

[75] Inventors: Ashford C. Greeley, Scottsdale; Sam M. Daniel, Tempe, both of Ariz.

[73] Assignee: Motorola Inc., Schaumburg, Ill.

[21] Appl. No.: 684,594

[22] Filed: May 10, 1976

Related U.S. Application Data

[63] Continuation-in-part of Ser. No. 565,514, April 7, 1975, abandoned.

[51] Int. Cl.[2] ..... G01S 9/04; G06F 15/58

[52] U.S. Cl. ..... 235/413; 343/5 DP; 343/12 MD; 364/300; 364/423

[58] Field of Search ..... 235/61.5 S, 150.2, 150.25, 235/150.26, 150.27; 343/5 DP, 12 MD, 15

[56] References Cited

U.S. PATENT DOCUMENTS

| | | | |
|---|---|---|---|
| 3,611,373 | 10/1971 | Cartwright | 343/12 MD |
| 3,618,099 | 2/1971 | Johnson | 343/12 MD |
| 3,659,085 | 4/1972 | Potter et al. | 235/150.2 |
| 3,706,096 | 12/1972 | Hammack | 343/15 |
| 3,710,331 | 1/1973 | Kiisk | 235/150.27 |
| 3,821,523 | 6/1974 | Chisholm et al. | 235/150.27 |
| 3,881,096 | 4/1975 | Schmidt | 235/150.27 |

FOREIGN PATENT DOCUMENTS

| | | | |
|---|---|---|---|
| 1,214,754 | 4/1966 | Germany | 235/150.2 |
| 1,240,146 | 5/1967 | Germany | 235/150.2 |
| 1,952,054 | 8/1970 | Germany | 343/5 DP |

*Primary Examiner*—Felix D. Gruber
*Attorney, Agent, or Firm*—M. David Shapiro

[57] ABSTRACT

A system for measuring the minimum miss distance and direction in three planes of a missile trajectory with respect to a target. Space diverse sequential range measurements are made from a plurality of pulse radar sensors mounted on the target. The range measurements are position identified in pairs of data transmitted to a data processor. The data processor adds time data and utilizes a nonlinear conjugate directions algorithm to solve for the minimum miss distance vector with a high degree of accuracy in a relatively short time period.

20 Claims, 5 Drawing Figures

MINIMUM MISS DISTANCE VECTOR MEASURING SYSTEM

This is a Continuation-in-Part of application Ser. No. 565,514 filed on Apr. 7, 1975 and now abandoned.

FIELD OF THE INVENTION

The invention relates to the solution of the minimum miss distance vector problem of a missile trajectory past a target.

BACKGROUND OF THE INVENTION

Matrix inversion techniques utilized in attempts to solve this problem before have yielded poor results because of the instability of the mathematical model and the indeterminate nature of the required matrix inversion. Simple triangulation methods fail because of discontinuities and insufficient baseline lengths to provide adequate accuracy. A Gauss-Newton estimation procedure has been the classic approach to the problem. (See Ortega and Rheinboldt, infra, at p. 267.) This incorporates the use of quasi-linear estimation techniques. The short baseline lengths of these systems account for excessive sensitivity of trajectory parameters on very small range errors, manifested in a highly ill-conditioned covariance matrix, making the estimate inaccessible.

SUMMARY OF THE INVENTION

In the present invention, space diverse electronic range sensors are mounted on the target to sequentially sense a plurality of ranges to the missile as the missile approaches the target. The range data so accumulated is communicated, together with corresponding sensor identification data, to a digital data processor. The data processor, utilizing one of several possible nonlinear estimation algorithms, iteratively establishes the minimum miss distance vector of the missile with great accuracy and in a relatively short period of time. Any of the mathematical methods allows for missing data and is very stable in operation.

It is an object of the invention to provide a plurality of range and time data points for a missile having a trajectory in the vicinity of a target.

It is a further object of the invention to utilize digital data processing techniques to derive a minimum miss distance vector for the missile.

It is still a further object of the invention to provide the minimum miss distance vector in a short period of time, in the absence of some data pairs and in a stable manner.

It is an additional object of the invention to provide the minimum miss distance vector in the absence of continuous or unambiguous data.

Figure 5:
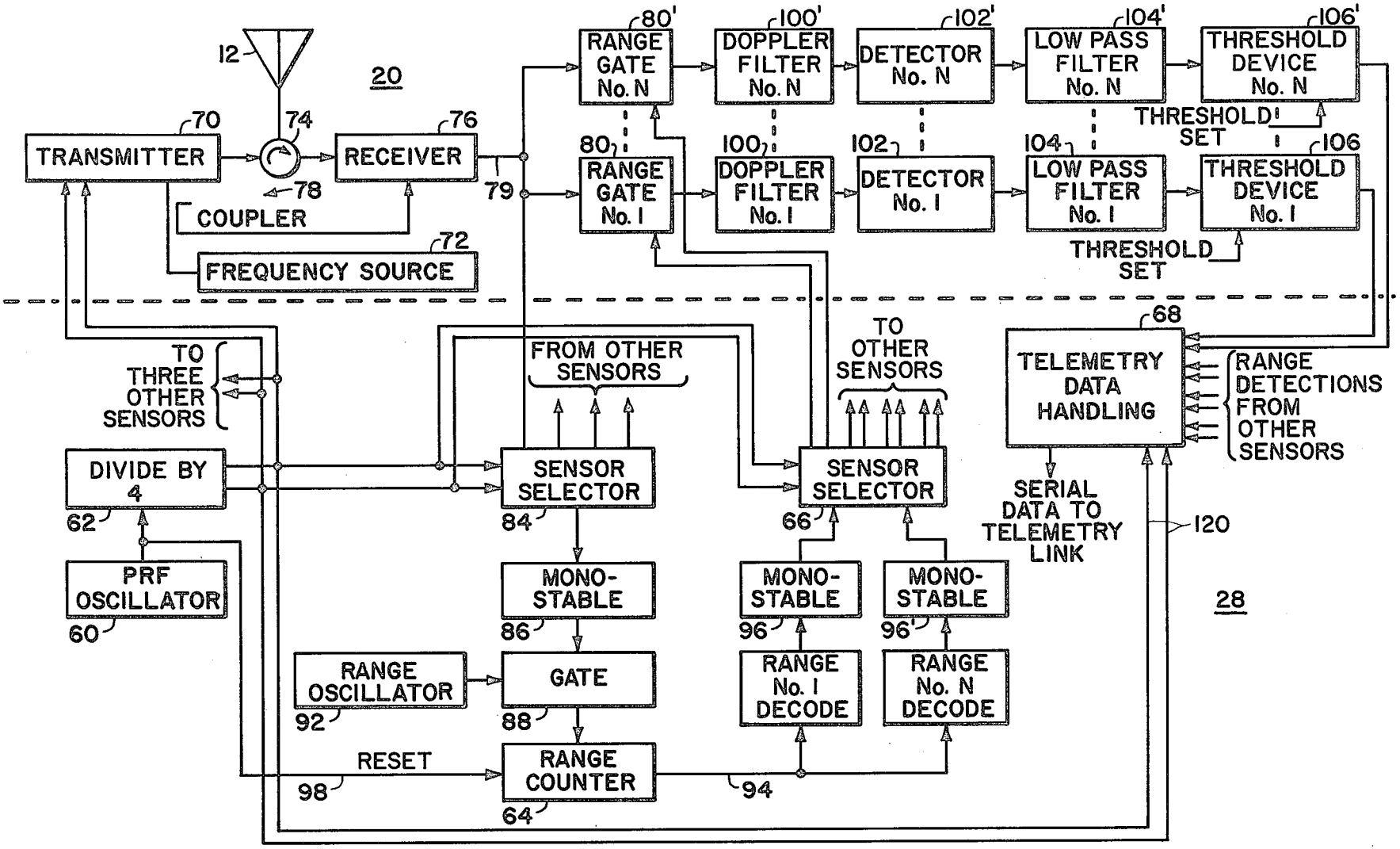
FIG. 5 illustrates in a more detailed block diagram form, synchronizer 28 of FIG. 1.

Telemetry Data Handling Unit 68 of FIG. 5 may be designed by one having average skill in the art.

DETAILED DESCRIPTION OF THE PREFERRED EMBODIMENT

Referring to the drawing, it will be seen that the target aircraft 10 has four antennas 12, 14, 16 and 18 mounted respectively on a rudder tip, each of the wing tips and a point well forward. These antennas are fed by Receiver-Transmitters (R/T units) 20, 22, 24 and 26, respectively, of a multi-signal radar system. Each of the R/T units emits a radar pulse in sequence. These pulses may be, for example, 40 nanoseconds long and they are transmitted sequentially under control of synchronizer 28 on the target which may be an aircraft. The time spacing between the radar pulses may be, for example, 400 nanoseconds. This allows reflections from missile 30 to return to the receiver associated with the emitting transmitter before the next transmitter pulse is emitted. This is true because the maximum distance range necessary may be on the order of 185 feet.

The synchronizer 28 may incorporate range gate functions to prohibit reception of range signals other than from desired ranges. In the preferred embodiment of the invention, the maximum range is limited to 185 feet and the range gates are programmed to step in increments of ¼ foot.

Time separation of the four R/T unit pulses avoids the necessity for operating the units on different frequencies or otherwise identifying a particular return pulse with a given transmitted pulse. The utilization of the range gate stepping system also avoids excessive extraneous noise in the system.

As a pulse is emitted from each one of the R/T units 20, 22, 24 and 26, the synchronizer 28 starts a range counter. The pulse signal is reflected 34 from the missile and received in the same R/T unit where it is converted to a video signal. Each of these video signals is then fed to the synchronizer 28 and each is used to stop a range counter, thereby creating a digital signal which is proportional to the range between the missile 30 and the target 10.

An appropriate digital word is generated in synchronizer 28, incorporating this digital range and a digital code which serves to identify the particular R/T unit and antenna from which the range data was derived.

Referring to FIG. 5, PRF oscillator 60 generates a frequency of, for example, 1.6 megahertz. This frequency is divided by four in circuit 62. Each of sensors 20, 22, 24 and 26 (FIG. 1) is synchronized to transmit upon receipt of each fourth oscillator pulse from PRF oscillator 60. Divide by four circuit 62 furnishes a two bit code which (a) identifies which of sensors 20, 22, 24 or 26 triggers range counter 64, (b) allows steering of range gate pulses by sensor steering unit 66 to the appropriate sensor, and (c) allows telemetry data handling unit 68 to tag each range detection with the appropriate sensor identification.

Figure 1:
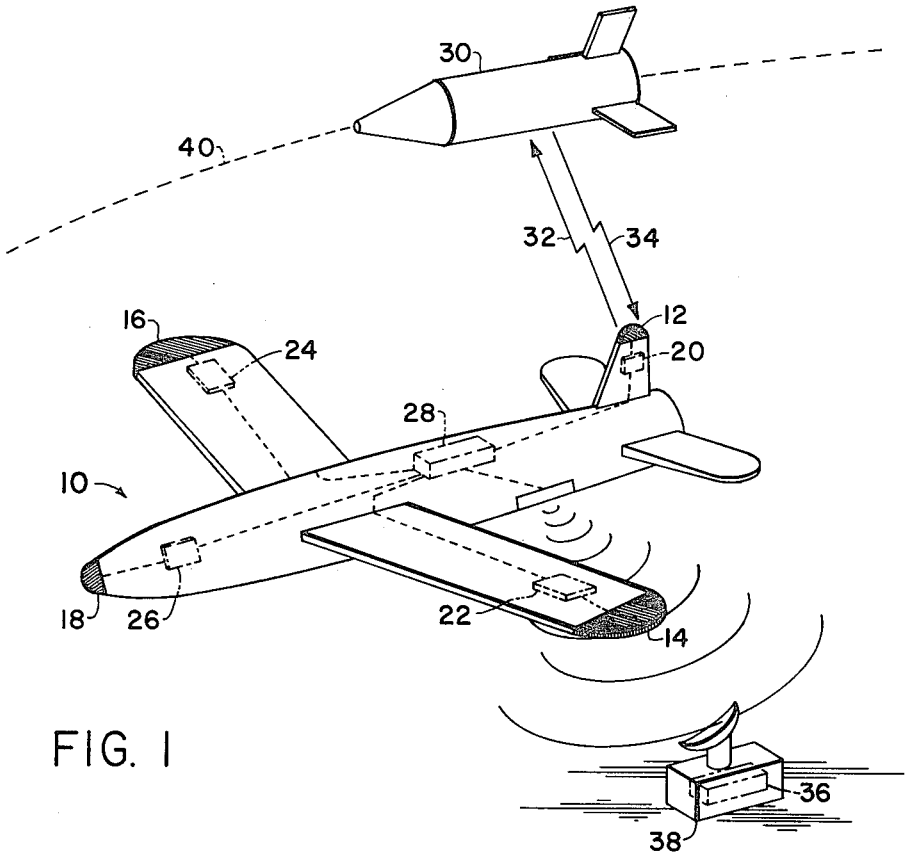
FIG. 1 illustrates the operational configuration of the system of the invention.
Figure 4:
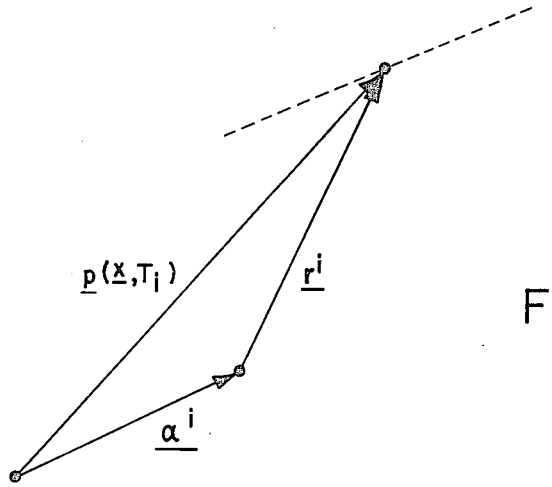
FIG. 4 illustrates the essential detection geometry of the system of the invention.

FIG. 5 synchronizer 28, also shows sensor 20 (See FIG. 1). It will be understood that sensors 22, 24 and 26 operate in the same manner as sensor 20. Divide by four circuit 62 outputs a two bit PRF code to transmitter 70. It will be understood that this two bit code may comprise four different combinations, 00, 01, 10, and 11, on successive PRF input pulses. Transmitter 70, for example, may respond to, for instance, the 00 code. Transmitters in the other three sensors 22, 24 and 26 will, of course, each respond to one of the other three two bit code combinations. When transmitter 70 recognizes, for example, the 00 code, it is enabled to output a transmitter pulse at the frequency of frequency source 72 through circulator 74 to antenna 12. Transmitter 70 accomplishes this output by gating a portion (approximately 40 nanoseconds) of continuously running frequency source 72 to antenna 12. This radio frequency pulse is transmitted 32 to missile 30 (see FIG. 1) and returned 34 back to antenna 12. Antenna 12 feeds this signal through circulator 74 to receiver 76. Receiver 76 amplifies the signal and mixes it with a sample of transmitted frequency from frequency source 72 by means of coupler 78. Circulator 74 serves as a duplexer connecting transmitter 70, antenna 12 and receiver 76 in the proper relationship, as is well known in the art. The output of receiver 76 is a series of bipolar video pulses at the PRF rate and with a width commensurate with the transmitter gate width, for approximately 40 nanoseconds as above-mentioned. These pulses are fed to N range gate channels 80, 80' in the signal processing section of the sensor. It will be understood that the number of N-range gate channels will be determined by the required accuracy and maximum range of the system.

A portion of the transmitter pulse will be amplified by receiver 76, converted to a video pulse and be fed through sensor selector 84 to trigger monostable 86. The duration of monostable 86 is slightly longer than the time required for a reflected signal to be received from maximum range. Monostable 86 then opens gate 88 allowing counter 64 to count cycles of range oscillator 92, which may be at a frequency of, for example, 250 megahertz. A number of sample times (N) are generated by decoding counter output 94. At each desired time (corresponding to a range from sensor 20), monostables 96, 96' are triggered, forming a sampling pulse approximately 40 nanoseconds wide. This pulse allows a range gate to sample receiver 76 output at a fixed range for many PRF intervals, thus recovering pulse amplitude modulation at a Doppler frequency rate if target 30 (see FIG. 1) is present at the selected range. Range counter 64 is reset to zero each PRF interval by output 98 from PRF oscillator 60.

Target detection for each range interval is accomplished by feeding output 79 of receiver 76 through a signal processing chain comprising range gates 80, 80', Doppler filters 100, 100', detectors 102, 102', low pass filters 104, 104' and threshold devices 106, 106'. The number, N, of signal processing channels is determined by the accuracy and maximum range desired. Range gates 80, 80' (sometimes referred to as boxcar circuits) recover an audio signal generated by Doppler shift of moving target 30 (see FIG. 1). This signal is filtered, detected (rectified) and fed to low pass filters 104, 104' with a time constant much lower than the period of the lowest Doppler frequency expected. Presence of the target in the prescribed range interval will ultimately allow output of low pass filters 104, 104' to exceed a threshold, allowing indication of target presence to telemetry data handling unit 68. In addition to multiplexing data for serial transmission through a telemetry link to the ground station telemetry data handling unit 68 may assign a time tag to each range detection.

Since the R/T units 20, 22, 24 and 26 sequentially sense the ranges to the missile, a digital counter 64 provides data to synchronizer 28 corresponding to each R/T unit. The data from counter 64, identified as to which R/T unit and antenna it was derived, is then used to digitally modulate a carrier signal used to transmit the data pairs to a remotely located data processor 36. (See FIG. 1.)

Of course, data processor 36 does not have to be located remotely, but could be located in, on, or near target 10. In these cases, wire connections may be used to connect the data output from synchronizer 28 to data processor 36.

However, in the case of remote location of the data processor 36, the digital signal is demodulated at the remote location and fed to data processor 36. Data processor 36 adds time of acquisition data to each segment of range-sensor identification data received. The data processor is also provided with information as to the relative positions of the antennas on the target vehicles.

Data processor 36, part of ground station 38 is programmed to provide a mathematical solution for trajectory 40 of missile 30 with respect to target 10 and to provide the minimum miss distance vector of missile trajectory 40.

One of several mathematical methods known as "Conjugate Directions" may be utilized to accomplish, by an iterative process, the solution of the miss distance vector problem in conjunction with the system of the invention described herein.

The first method is the one commonly known in the art as the "Steepest Descent" Algorithm. This algorithm is well known in the art and, for example, may be found completely described by Ortega, J. M. and Rheinboldt W. C., *Iterative Solution of Nonlinear Equations in Several Variables,* Academic Press, 1970, p. 245. The second method is one commonly known as the Conjugate Gradients Algorithm. This algorithm is also well known in the art and, for example, may be found completely described by Hestenes, M. R. and Stiefel, E., "Methods of Conjugate Gradients for Solving Linear Systems", Journal of Research of the National Bureau of Standards, 1952, Vol. 49, No. 6, pp. 409–436. Either method involves estimations of the trajectory by dynamic triangulation means followed by direct computation of the minimum miss distance vector.

For all practical purposes it suffices to assume a quadratic path model for the relative missile trajectory, namely, $$p(t) = at^2 + vt + s \tag{1}$$

where $p(t)$ represents the 3-dimensional relative trajectory vector, while $a$, $v$ and $s$ stand for three-dimensional relative acceleration, velocity and displacement vectors comprising the nine-dimensional trajectory state vector $$x = \begin{bmatrix} a \\ v \\ s \end{bmatrix} \tag{2}$$

The paragraphs which follow are concerned with the fundamental problem of estimating $x$ from measured range and time data and the subsequent determination of the minimum miss distance vector.

It is shown below that the estimation of $x$ is formulated as a minimum-seeking problem. The ensemble of measured data is incorporated into a functional $F(x)$ having a minimum value at an optimal estimate $\hat{x}$ corresponding to the least-squares solution.

Figure 2:
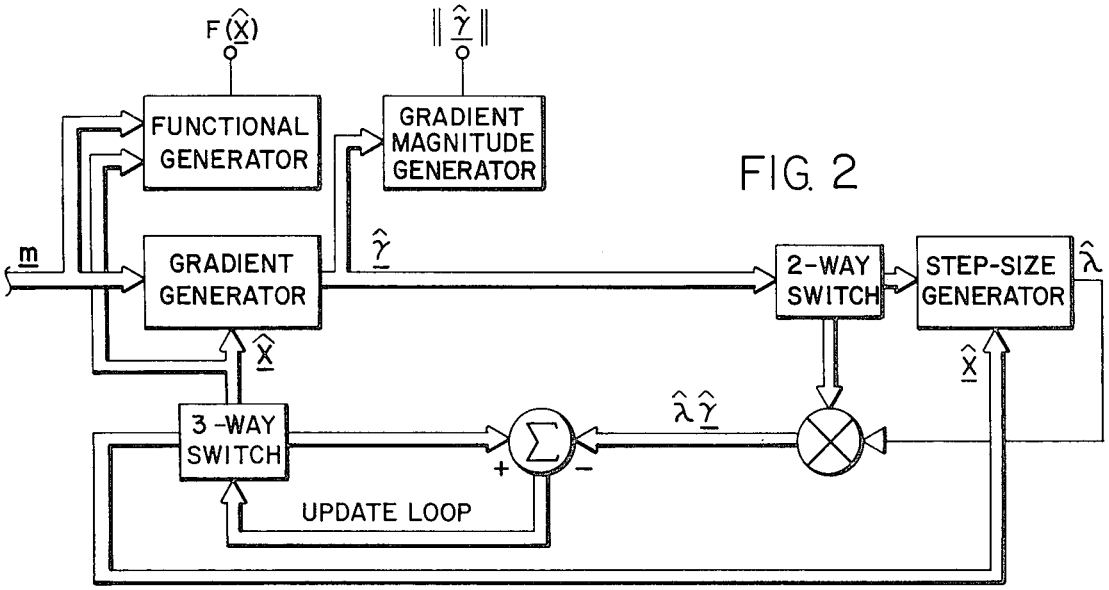
FIG. 2 illustrates the operational block diagram of the "steepest descent" algorithm which may be utilized in the data processor of the invention.

Assume a total of N detections. With reference to FIG. 2 the $i$th detection simply states that $$\| r \|^2 - R_i^2 = 0 ; i = 1 \ldots N \tag{3}$$

where $r^i = p(x, T_i) - \alpha^i$ $r^i$ = the range vector at $t = T_i$ $p(x, T_i)$ = trajectory vector at $t = T_i$ $\alpha^i$ = antenna position vector at $i$th detection $R_i$ = scalar range at $t = T_i$ Unlike a linear system of equations, the quadratic system (3) does not lend itself to direct root-finding methods. Instead, one may get a least-squares approximation by simply solving an "equivalent" minimum seeking problem involving the minimization of a functional associated with system (3).

A convenient functional is derived as follows. Corresponding to the set of N detections, define the error functions $$F_i(x) = \| r^i \|^2 - R_1^2 ; i = 1 \ldots N \tag{4}$$

Construct a functional by forming some convenient combination of these functions whose minimum constitutes a compromise to minimizing each $F_i$ individually. One such functional is:

$$F(x) = \sum_{i=1}^{N} F_i^2 \tag{5}$$

namely, the unweighted sum of squared error functions. The value of $x$ that minimizes F $(x)$ constitutes a least-squares approximation to system (3). A weighted functional of the form $$F(x) = \sum_{i=1}^{N} W_i F_i^2 \tag{6}$$

where:

$W_i$ = weighting coefficient may be used, allowing for stochastic nonlinear optimal estimation.

The weighting coefficient, $W_i$, is given by:

$$W_i = 1/E\{[\| r^i \|^2 - (\tilde{R}_i + \xi_i)^2]^2\}$$

where:

$\xi_i$ = random variable representing $i$th measurement error.

$\tilde{R}_i$ = exact scalar range at $t = t_i$.

$E$ = the expectation operator

Note that $\tilde{R}_i + \xi_i = R_i$, the measured scalar range at $T = T_i$. When $\xi_i$ is assumed to be a normally distributed random variable having a mean $\mu_i$ and variance $\sigma_i^2$, the $i$th weighting coefficient may be shown to be, specifically, $$W_i = 1/[4R_i^2(\sigma_i^2 + \mu_i^2) + 4R_i\mu_i(3\sigma_i^2 + \mu_i^2) + 3\sigma^4 + 6\sigma_i^2\mu_i^2 + \mu_i^4]$$

The analysis which follows applies to equation (5), above. If the analysis is to be applied to equation (6), above, $W_i$, the weighting coefficient must be added as a multiplying factor within the summation of each of equations (7), (8), (12), (13), (14) and (15), below.

Following is a description of three numerically-stable parameter optimization procedures useful for minimizing F$(x)$ and generating an optimal estimate $\hat{x}$ that characterizes the missile trajectory relative to the target.

The three optimization methods discussed below are classified as descent or relaxation methods which start with an initial guess for $x$ and subsequently generate improved estimates by optimally relaxing F$(x)$ along intrinsic search directions in an iterative manner, eventually producing an estimate sufficiently indistinguishable from the optimal solution.

The Steepest Descent method is the simplest of the three parameter optimization techniques considered. It is characterized by optimal relaxation along negative gradient directions. [The gradient of a scalar function F$(x)$ is the vector of partials $\nabla_x F(x)$ pointing in the direction of maximum increase of F$(x)$ from point $x$. As such, the gradient represents the sensitivity of F$(x)$ with respect to $x$.]

The specific algorithm for minimizing F$(x)$ is given below:

i. Given estimate $\hat{x}$ ii. Compute gradient vector $$\hat{\gamma} = \nabla_x F(x) \mid_{x = \hat{x}}$$

iii. Compute optimal step-size $\hat{\lambda}$ from $$\frac{d}{d\lambda} F(\hat{x} - \lambda\hat{\gamma}) = 0$$

iv. Update current $\hat{x}$ by $$\hat{x} = \hat{x} - \hat{\lambda}\,\hat{\gamma}$$

and return to (ii).

The algorithm is repeated until $\hat{\gamma}$ has reached a sufficiently small neighborhood of zero whence subsequent iterations do not add discernably to $\hat{x}$.

A visual aid toward understanding the filtering process of the algorithm is given in FIG. 2 in the form of its functional block diagram. Input $m$ represents the measurement vector; in this case, the Sensor-Range-Time data. Input $\hat{x}$ stands for the current estimate of the state vector. The gradient generator simply takes $m$ and $\hat{x}$ and produces the gradient or sensitivity vector $\hat{\gamma}$. A two-way switch first presents $\hat{\gamma}$ into a step-size generator, which along with $\hat{x}$ produces the optimal step-size $\hat{\lambda}$ [may be thought of as the optimal gain of the feedback amplifier] which, in turn, multiplies the subsequently switched $\hat{\gamma}$ resulting in the updating step $\hat{\lambda}\,\hat{\gamma}$. The current estimate $\hat{x}$ is now updated to $\hat{x} - \lambda\hat{\gamma}$ by means of the update loop in a manner regulated by the three-way switch there. Included in the block diagram are two convergence indicators, namely, the functional value F$(x)$ and the gradient magnitude $\| \gamma \|$. Note that, unlike a common feedback controller, the Steepest Descent controller employs a feedforward loop that presents $\hat{x}$ into the step-size generator; without it, $\hat{\lambda}$ could not be determined nor could stability be guaranteed.

The reader is invited to turn his attention to the actual computations needed to implement the Steepest Descent process. It can be shown that for the functional:

$$F(x) = \sum_{i=1}^{N} F_i^2 \tag{7}$$

the gradient vector is given by $$\gamma = 2 \sum_{i=1}^{N} F_i \frac{\delta F_i}{\delta x} \tag{8}$$

in view of (4)

$$F_i = (M_i x - a^i)^T (M_i x - a^i) - R_i^2 \tag{9}$$

$$\frac{\delta F_i}{\delta x} = 2 M_i^T r^i \tag{10}$$

where $$M_i = [T_i^2 I \vdots T_i I \vdots I] \tag{11}$$
$$= \text{the } 3 \times 9 \text{ } i\text{th detection-time matrix.}$$

Combining in (8) yields $$\gamma = 4 \sum_{i=1}^{N} F_i M_i^T r^i \tag{12}$$

In compact Kronecker notation (12) takes the alternate form $$\gamma = 4 \sum_{i=1}^{N} F_i r^i \otimes r^i \tag{13}$$

where $$r^i = \begin{bmatrix} T_i^2 \\ T_i \\ 1 \end{bmatrix}, \text{ the } i\text{th detection-time vector}$$

and $\otimes$ is the symbol denoting Kronecker multiplication of vectors. (See, Bellman, R., *Introduction to Matrix Analysis,* McGraw Hill, 1960, pp. 223–239.) The optimal step-size is simply that value of $\lambda$ which minimizes $F(x - \lambda\gamma)$. This is a single-variable minimization problem carried out as indicated below. Explicitly, $$\begin{aligned} F(x - \lambda\gamma) &= \sum_{i=1}^{N} (\| M_i(x - \lambda\gamma) - a^i \|^2 - R_i^2)^2 \\ &= \sum_{i=1}^{N} (\| r^i - \lambda M_i \gamma \|^2 - R_i^2)^2 \\ &= \sum_{i=1}^{N} (F_i - 2\lambda r^{iT} M_i \gamma + \lambda^2 \| M_i \gamma \|^2)^2 \\ &= \sum_{i=1}^{N} (A_i \lambda^2 + B_i \lambda + C_i)^2 \end{aligned} \tag{14}$$

where:

$A_i = \| M_i \gamma \|^2$ $B_i = 2r^{iT}$ $C_i = F_i.$ evidently a quartic function of the parameter $\lambda$. To get the optimal value of $\lambda$, simply set the first $\lambda$-derivative to zero and solve the resulting equation, namely $$\begin{aligned} \frac{d}{d\lambda} F(x - \lambda\gamma) &= 0 \\ &= 2 \sum_{i=1}^{N} (2\lambda A_i + B_i)(A_i \lambda^2 + B_i \lambda + C_i) \\ &= 2 \sum_{i=1}^{N} \{2A_i^2 \lambda^3 + 3A_i B_i \lambda^2 + (2A_i C_i + B_i^2)\lambda + B_i C_i\} \end{aligned} \tag{15}$$

Using the Newton's method (see Ortega and Rheinboldt, supra) this can be solved for the three possible roots numerically. The root appropriate for this purpose is the smallest real positive root. This choice insures optimal descent within a convex neighborhood of the search.

Although the Steepest Descent method is numerically stable, it is by no means efficient in the sense of convergence speed. In contrast with the Steepest Descent method, other more sophisticated parameter optimization techniques are known to guarantee convergence within a finite number of iterations. In their paper, M. R. Hestenes and E. Steifel supra, introduce the method of Conjugate Gradients and show that convergence may be attained within a number of iterations not exceeding the dimensionality of $x$, provided that $F(x)$ is a quadratic functional. The corollary here is that only a finite number of iterations are needed for the quartic $F(x)$ in the present case.

The specific Conjugate Gradients algorithm for minimizing a given functional $F(x)$ with respect to $x$ is as follows:

i. Given estimate $\hat{x}$ ii. Compute gradient vector $$\hat{\gamma} = \nabla_x F(x) \mid_{x=\hat{x}}$$

iii. Using the previous gradient vector $\hat{\gamma}$, update the current search vector by $$\hat{s} = -\hat{\gamma} - \frac{\| \hat{\gamma} \|^2}{\| \hat{\gamma} \|^2} \hat{s}$$

iv. Compute optimal step-size $\hat{\lambda}$ from $$\frac{d}{d\lambda} F(\hat{x} + \lambda \hat{s}) = 0$$

v. Update current estimate by $$\hat{x} = \hat{x} + \hat{\lambda} \hat{s}$$

and return to (ii).

Figure 3:
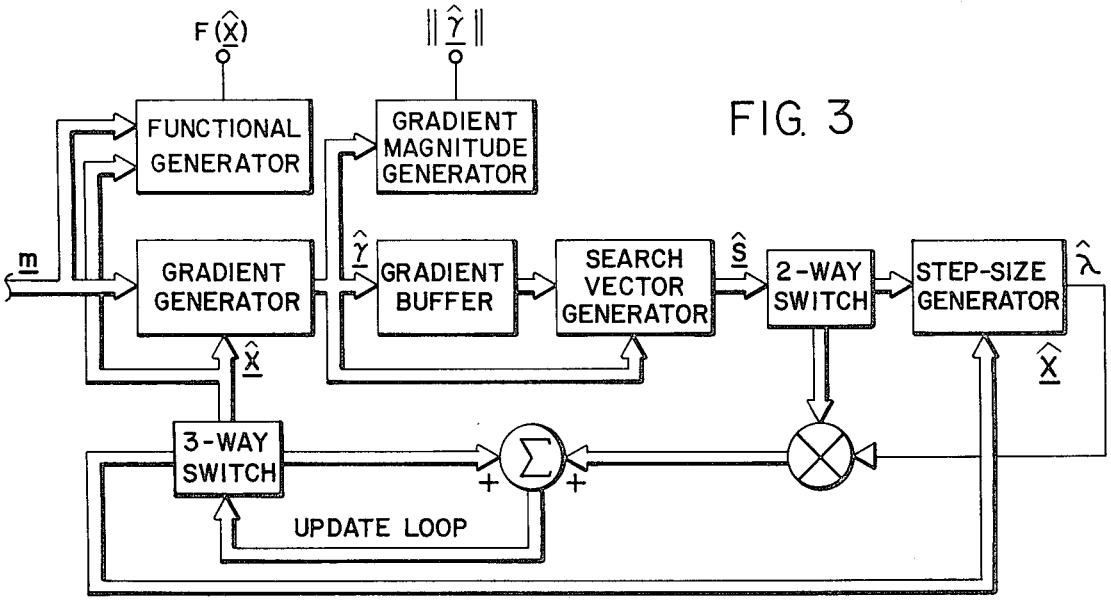
FIG. 3 illustrates the operational block diagram of the "N-step Conjugate Gradients" algorithm which may be utilized in the data processor of the invention.

A functional block diagram for the Conjugate Gradients process is given in FIG. 3.

One variation of the Conjugate Gradients algorithm involves a somewhat simpler updating formula for the search vector $\hat{s}$, namely, $$\hat{s} = -\hat{\gamma} + \frac{\| \hat{\gamma} \|^2}{\| \hat{\gamma} \|^2} \hat{\gamma}$$

resulting in the so-called One-step Conjugate Gradients method.

As its name might imply, the N-Step Switched Conjugate Gradients Method variation of the Conjugate Gradients Method consists of using the normal update formula for $\hat{s}$ throughout blocks of N consecutive iterations, at the end of which $\hat{s}$ is reset to zero. This scheme is numerically efficient.

With the relative trajectory vector estimate $\hat{x}$ at hand, it is now possible to determine the vector of closest proximity. The vector of smallest magnitude that joins the target origin with the missile trajectory is sought. The magnitude of the joining vector is $$d(t) = \| M\hat{x} \|^2$$

$$= \| [t^2 I \vdots tI \vdots I]\, \hat{x} \|^2$$

a quartic function of time through matrix $M = M(t)$. Distance $D(t)$ is minimum at a time $t = t_{min}$ satisfying $$\frac{d}{dt} D(t) = \left( \frac{d}{dt} M\hat{x} \right)^T (M\hat{x}) = 0$$

a cubic equation. Determing $t_{min}$ by means of Newton's method, the minimum miss distance vector is given by $$\widehat{MMV} = M(t_{min})\, \hat{x}.$$

Of the three trajectory estimation techniques discussed, the Steepest Descent algorithm is the slowest, the One Step Conjugate Gradients Algorithum is between 5 and 10 times faster and the N-step conjugate Gradients Algorithm utilizing 100 steps is approximately 10 times faster than the One Step Conjugate Gradients method. While it is clear, then, that a 100 Step Conjugate Gradients Algorithm is the most efficient, any one of the three systems may be used to solve the problem in the system of the invention.

Related conjugate directions algorithms such as the "Davidon-Fletcher-Powell" may be used with equal success. (See Ortega and Rheinboldt, supra, at p. 248.) In general, any descent or relaxation method may be used.

Data process 36 may be any one of commercially available computers such as, for example, Xerox Data System Model Sigma 5, properly programmed. The FORTRAN IV program which follows has been used with a Sigma 5 computer in a simulation of data processor 36 and has been found effective.

The FORTRAN IV program contains not only the estimation scheme essential to the proper operation of the system, but provisions, as well, for evaluating its performance by means of computational error analysis and generating appropriate statistics. As given, the program consists of several distinct parts: namely, MAIN : The controlling program that calls primary subroutines RTDATA, SD, MISVEC, and PLOTi.

RTDATA : The subroutine that reads in necessary program control parameters and system specifications as well as detected data. In addition, this subroutine perturbs the given data in accordance to an error process for the purpose of evaluating the performance of the estimation procedure with data corrupted by noise. The latter feature is, of course, not essential to the operation of the system.

SD : With detection information available through RTDATA, this subroutine exercises the conjugate gradients estimation process. The end result is a trajectory description in terms of vector acceleration, *a*, vector velocity, *v*, and vector displacement, *s*.

MISVEC : With a trajectory specified according to SD, this subroutine computes the minimum miss vector, the vector that connects the target origin to the projectile at the time of closest proximity, given in target coordinates. In addition, this subroutine generates appropriate statistics useful in evaluating the performance of the estimation process using noisy detection data.

PLOTi : This subroutine generates a histogram of vector magnitude errors. It is not essential to the operation of the system.

ROOT : This secondary subroutine serves SD as well as MISVEC in computing roots of cubic equations involved in each.

Included also is a listing of 156 data cards necessary for the present program to work as a simulation program, given that appropriate control cards are used. The detected data given has been generated computationally. In actual operation such data will be provided by the system of the invention. A program illustrative of the present invention is set out herein below.

```
C  ==================================================================
C  |                                                                |
C  |                        RT  VMDI  PROCESS                       |
C  |                        =================                       |
C  |                                                                |
C  |          SIMULATION  BY :   S. M. DANIEL                       |
C  |                             MOTOROLA, INC.                     |
C  |                             SCOTTSDALE, ARIZONA   85282        |
C  |                             APRIL, 1974                        |
C  |                                                                |
C  |================================================================|
C  |                                                                |
C  |            MINIMUM DISTANCE MISS VECTOR COMPUTATION            |
C  |                 THROUGH TRAJECTORY ESTIMATION                  |
C  |                          USING                                 |
C  |          SWITHCHED N-STEP CONJUGATE GRADIENTS CONTROL          |
C  |                   WITH STABILITY PROTECTION                    |
C  |                                                                |
C  |================================================================|
      COMMON /SET0/ DT,GMIN,F,IFLAG,IOPTN,IOPTN1,ISRCH,JUMP,JSWCH
      COMMON /SET1/ ISWCH1,ISWCH2,ISTEP,ITERX,INRX,IMOD
      COMMON /SET2/ ANT(3,5),RN(80),TM(80),XM(9),IANT(80),IRG(80),NDET
      COMMON /SET3/ VMDO(3),SMDO,ITRL,ITRLX
      COMMON /SET4/ XMSVER,XMSSER,AVGVER,AVGSER,VSIGMA,SSIGMA
      COMMON /SET5/ IVERR(20)
1000  CONTINUE
      CALL RTDATA
      IF(IFLAG.EQ.1) GOTO 2000
      CALL SD
```

```
      CALL MISVEC
      GOTO 1000
 2000 CONTINUE
      CALL PLOT1(IVERR,20,ITRL,32)
      CALL EXIT
      END

      SUBROUTINE RTDATA
      DIMENSION AR20(20),AR8(8),BR8(8),AR5(5),XMO(9)
      DIMENSION ADIR(3,5),ADOT(5),RG(16),TMO(80)
      COMMON /SET0/ DT,GMIN,F,IFLAG,IOPTN,IOPTN1,ISRCH,JUMP,JSWCH
      COMMON /SET1/ ISWCH1,ISWCH2,ISTEP,ITERX,INRX,IMOD
      COMMON /SET2/ ANT(3,5),RN(80),TM(80),XM(9),IANT(80),IRG(80),NDET
      COMMON /SET3/ VMDO(3),SMDO,ITRL,ITRLX
      COMMON /SET4/ XMSVER,XMSSER,AVGVER,AVGSER,VSIGMA,SSIGMA
      COMMON /SET5/ IVERR(20)
  100 FORMAT(20A4)
  150 FORMAT(15X,20A4)
  200 FORMAT(8A4,I15,8A4)
  250 FORMAT(15X,8A4,I15,8A4)
  300 FORMAT(8A4,F15.3,8A4)
  350 FORMAT(15X,8A4,F15.3,8A4)
  400 FORMAT(5A4,I10)
  450 FORMAT(15X,5A4,I10)
  500 FORMAT(5A4,3F10.2)
  550 FORMAT(15X,5A4,3F10.2)
  575 FORMAT(15X,5A4,3F10.2)
  600 FORMAT(I8,2X,3F8.2,4X,3F8.2,4X,F8.2)
  650 FORMAT(15X,I8,2X,3F8.2,4X,3F8.2,4X,F8.2)
  700 FORMAT(NI10)
  710 FORMAT(NI5)
  725 FORMAT(NI4)
  750 FORMAT(15X,NI10)
  760 FORMAT(15X,NI5)
  800 FORMAT(NF10.2)
  810 FORMAT(NF5.1)
  850 FORMAT(15X,NF10.2)
  860 FORMAT(15X,NF5.0)
  900 FORMAT(1H1,/////)
  925 FORMAT(1H1,/)
  950 FORMAT(1H1,//)
  975 FORMAT(I5,2I20,F20.4)
  980 FORMAT(15X,I5,2I20,F20.4)
  985 FORMAT(9F8.2)
  990 FORMAT(1H1,/,15X,I15)
  995 FORMAT(2F10.2,I10)
      DATA IND/0/
      IF(IND.EQ.1) GOTO 1000
      READ(5,995) DT,GMIN,IFLAG
      WRITE(6,900)
      DO 5 I=1,11
      READ(5,100) AR20
    5 WRITE(6,150) AR20
      READ(5,200) AR8,IOPTN,BR8
      WRITE(6,250) AR8,IOPTN,BR8
      IOPTN1=IOPTN
      READ(5,200) AR8,ISRCH,BR8
      WRITE(6,250) AR8,ISRCH,BR8
      READ(5,200) AR8,JUMP,BR8
      WRITE(6,250) AR8,JUMP,BR8
      READ(5,200) AR8,ISWCH1,BR8
      WRITE(6,250) AR8,ISWCH1,BR8
      READ(5,200) AR8,ISWCH2,BR8
      WRITE(6,250) AR8,ISWCH2,BR8
      READ(5,200) AR8,ISTEP,BR8
      WRITE(6,250) AR8,ISTEP,BR8
      READ(5,200) AR8,ITERX,BR8
      WRITE(6,250) AR8,ITERX,BR8
      READ(5,200) AR8,INRX,BR8
      WRITE(6,250) AR8,INRX,BR8
      DO 10 I=1,2
      READ(5,100) AR20
   10 WRITE(6,150) AR20
      READ(5,300) AR8,TERR,BR8
      WRITE(6,350) AR8,TERR,BR8
      READ(5,100) AR20
      WRITE(6,150) AR20
      READ(5,200) AR8,ITRLX,BR8
```

```
      WRITE(6,250) AR8,ITRLX,BR8
      DO 15 I=1,13
      READ(5,100) AR20
15    WRITE(6,150) AR20
      WRITE(6,925)
      READ(5,700) 3,ITRL,IX,IMOD
      DO 20 I=1,7
      READ(5,100) AR20
20    WRITE(6,150) AR20
      READ(5,400) AR5,NANT
      WRITE(6,450) AR5,NANT
      READ(5,400) AR5,NRG
      WRITE(6,450) AR5,NRG
      DO 21 I=1,2
      READ(5,100) AR20
21    WRITE(6,150) AR20
      READ(5,500) AR5,SMDC
      WRITE(6,550) AR5,SMDO
      DO 25 I=1,6
      READ(5,100) AR20
25    WRITE(6,150) AR20
      DO 30 I=1,NANT
      READ(5,600) J,(ANT(K,J),K=1,3),(ADIR(K,J),K=1,3),ADOT(J)
30    WRITE(6,650) J,(ANT(K,J),K=1,3),(ADIR(K,J),K=1,3),ADOT(J)
      DO 35 I=1,2
      READ(5,100) AR20
35    WRITE(6,150) AR20
      READ(5,710) NRG,(I,I=1,NRG)
      WRITE(6,760) NRG,(I,I=1,NRG)
      READ(5,810) NRG,(RG(I),I=1,NRG)
      WRITE(6,860) NRG,(RG(I),I=1,NRG)
      DO 40 I=1,4
      READ(5,100) AR20
40    WRITE(6,150) AR20
      I1=1
      DO 45 J=1,3
      I3=I1+2
      READ(5,500) AR5,(XM(I),I=I1,I3)
      WRITE(6,575) AR5,(XM(I),I=I1,I3)
45    I1=I1+3
      DO 50 I=1,4
      READ(5,100) AR20
50    WRITE(6,150) AR20
      READ(5,500) AR5,(VMDO(I),I=1,3)
      WRITE(6,550) AR5,(VMDO(I),I=1,3)
      DO 55 I=1,2
      READ(5,100) AR20
55    WRITE(6,150) AR20
      WRITE(6,950)
      DO 60 I=1,5
      READ(5,100) AR20
60    WRITE(6,150) AR20
      READ(5,700) 1,NDET
      DO 65 I=1,NDET
      READ(5,975) J,IANT(I),IRG(I),TMO(I)
65    WRITE(6,980) J,IANT(I),IRG(I),TMO(I)
      READ(5,100) AR20
      WRITE(6,150) AR20
      READ(5,985) XMO
1000  IND=1
      CALL TLEFT(TL)
      IF(ITRL.EQ.ITRLX) GOTO 2000
      IF(TL.GT.DT) GOTO 3000
2000  CONTINUE
      WRITE(7,700) 3,ITRL,IX,IMOD
      WRITE(7,800) 6,XMSVER,XMSSER,AVGVER,AVGSER,VSIGMA,SSIGMA
      WRITE(7,725) 20,IVERR
      IFLAG=1
      RETURN
3000  CONTINUE
      ITRL=ITRL+1
      WRITE(6,990) IX
      DO 75 I=1,NDET
      RN(I)=RG(IRG(I))
      ZSUM=0.0
      DO 70 J=1,3
      CALL RANDU(IX,IY,Z)
70    ZSUM=ZSUM+Z
```

```
150.    75    TM(I)=TMO(I)+TERR*(2.0*ZSUM-3.0)
151.          DO 80 I=1,9
152.    80    XM(I)=XMO(I)
153.          RETURN
154.          END

 1.           SUBROUTINE SD
 2.           DIMENSION R(3,80),F1(80),G(9),G1(9),S(9),CF(4)
 3.           COMMON /SET0/ DT,GMIN,F,IFLAG,IOPTN,IOPTN1,ISRCH,JUMP,JSWCH
 4.           COMMON /SET1/ ISWCH1,ISWCH2,ISTEP,ITERX,INRX,IMOD
 5.           COMMON /SET2/ ANT(3,5),RN(80),TM(80),XM(9),IANT(80),IRG(80),NDET
 6.           COMMON /SET3/ VMDO(3),SMDO,ITRL,ITRLX
 7.    100    FORMAT(15X,66('='),/,30X,'PERFORMANCE SUMMARY FOR TRIAL #',
 8.          =I3,/,15X,66('='),//15X,'CONTROL DYNAMICS',/,15X,16('='),//,21X,
 9.          ='ITER',16X,'ERROR',18X,'SENSITIVITY',/)
10.    200    FORMAT(I25,2F25.2)
11.    300    FORMAT(///,15X,'MISSILE TRAJECTORY PARAMETERS',/,15X,29('='),//,
12.          =19X,'ACCELERATION    :',3F10.2,/,19X,'VELOCITY        :',3F10.2,/,
13.          =19X,'DISPLACEMENT    :',3F10.2)
14.           WRITE(6,100) ITRL
15.           ITIME=0
16.           F0=1.0E+50
17.           C1=1.0
18.           C2=1.0
19.           DO 5 I=1,9
20.    5      S(I)=0.0
21.           ITER=0
22.    1000   F=0.0
23.           GMAG=0.0
24.           DO 6 I=1,9
25.    6      G(I)=0.0
26.           DO 10 I=1,4
27.    10     CF(I)=0.0
28.           DO 20 I=1,NDET
29.           CON1=RN(I)**2
30.           T=TM(I)
31.           T2=T**2
32.           RDR=0.0
33.           DO 15 J=1,3
34.           J3=J+3
35.           J6=J+6
36.           R(J,I)=XM(J)*T2+XM(J3)*T+XM(J6)-ANT(J,IANT(I))
37.    15     RDR=RDR+R(J,I)**2
38.           F1(I)=RDR-CON1
39.           F=F+F1(I)**2
40.           DO 20 J=1,3
41.           GFCTR=F1(I)*R(J,I)
42.           IF(IOPTN.LE.1) GOTO 1500
43.           G(J)=G(J)+GFCTR*T2
44.    1500   CONTINUE
45.           J3=J+3
46.           G(J3)=G(J3)+GFCTR*T
47.           J6=J+6
48.           G(J6)=G(J6)+GFCTR
49.    20     CONTINUE
50.           IF(F.LT.F0) GOTO 2000
51.           IF(ITIME.EQ.1) GOTO 2000
52.           ITIME=ITIME+1
53.           DO 25 I=1,9
54.           XM(I)=XM(I)+SZ*S(I)
55.    25     S(I)=0.0
56.           GOTO 1000
57.    2000   CONTINUE
58.           ITIME=0
59.           DO 30 I=1,9
60.    30     GMAG=GMAG+G(I)**2
61.           IF(ITER.LT.ISWCH1) GOTO 3000
62.           C2=GMAG
63.           C=C2/C1
64.           DO 35 I=1,9
65.           IF(ITER.GT.ISWCH1.AND.ITER.LT.ISWCH2) S(I)=G1(I)
66.           IF(JSWCH.EQ.0) S(I)=0.0
67.           S(I)=G(I)+C*S(I)
68.           G1(I)=G(I)
69.    35     G(I)=S(I)
70.    3000   CONTINUE
71.           GMAG=SQRT(GMAG)
72.           MITER=MOD(ITER,IMOD)
```

```
      IF(MITER.EQ.0) WRITE(6,200) ITER,F,GMAG
      DO 45 I=1,NDET
      T=TM(I)
      T2=T**2
      A1=0.0
      B1=0.0
      DO 40 J=1,3
      J3=J+3
      J6=J+6
      PG=G(J)*T2+G(J3)*T+G(J6)
      A1=A1+PG**2
40    B1=B1+2.0*PG*R(J,I)
      CF(1)=CF(1)+2.0*A1**2
      CF(2)=CF(2)+3.0*A1*B1
      CF(3)=CF(3)+2.0*A1*F1(I)+B1**2
45    CF(4)=CF(4)+B1*F1(I)
      CALL ROOT(CF,SZ,INRX,ISRCH)
      IF(ISRCH.EQ.0) SZ=ABS(SZ)
      MSTEP=MOD(ITER,ISTEP)
      DO 50 I=1,9
      IF(ITER.GT.ISWCH2.AND.MSTEP.EQ.0) S(I)=0.0
      XM(I)=XM(I)+SZ*G(I)
50    CONTINUE
      C1=CP
      F0=F
      ITER=ITER+1
      IF(GMAG.LT.GMIN.AND.IOPTN.EQ.0) GOTO 4000
      IF(GMAG.LT.GMIN.AND.IOPTN.EQ.2) GOTO 4000
      IF(GMAG.LT.GMIN.AND.IOPTN.EQ.1) IOPTN=2
      IF(ITER.LE.ITERX) GOTO 1000
4000  CONTINUE
      IOPTN=IOPTN1
      IF(MITER.NE.0) WRITE(6,200) ITER,F,GMAG
      WRITE(6,900) XM
      RETURN
      END
      SUBROUTINE MISVEC
      DIMENSION CF(4),VMD(3)
      COMMON /SET1/ ISWCH1,ISWCH2,ISTEP,ITERX,INRX,IMOD
      COMMON /SET2/ ANT(3,5),RN(80),TM(80),XM(9),IANT(80),IRG(80),NDET
      COMMON /SET3/ VMD0(3),SMD0,ITRL,ITRLX
      COMMON /SET4/ XMSVER,XMSSER,AVGVER,AVGSER,VSIGMA,SSIGMA
      COMMON /SET5/ IVERR(20)
100   FORMAT(///,15X,'SCORING STATISTICS',//,15X,18('-'),///,49X,'VECTOR',
     -19X,'SCALAR',//,19X,'SCORE            :',3F10.2,F15.2,/,19X,'ERROR
     -          :',F10.2,F35.2,/,19X,'MSE              :',F10.2,F35.2,/,19X,
     -'MEAN              :',F10.2,F35.2,/,19X,'SIGMA            :',F10.2,
     -F35.2)
200   FORMAT(/,15X,66('-'))
300   FORMAT(8F10.2)
900   FORMAT(20I4)
      DATA IND/0/
      IF(IND.EQ.0) READ(5,800) XMSVER,XMSSER,AVGVER,AVGSER,VSIGMA,SSIGMA
      IF(IND.EQ.0) READ(5,900) IVERR
      IND=1
      ITRL1=ITRL-1
      DO 10 I=1,4
10    CF(I)=0.0
      DO 20 I=1,3
      I3=I+3
      I6=I+6
      CF(1)=CF(1)+2.0*XM(I)**2
      CF(2)=CF(2)+3.0*XM(I)*XM(I3)
      CF(3)=CF(3)+2.0*XM(I)*XM(I6)+XM(I3)**2
20    CF(4)=CF(4)+XM(I3)*XM(I6)
      CALL ROOT(CF,T0,INRX,0)
      T02=T0**2
      SMD=0.0
      VMDERR=0.0
      DO 30 I=1,3
      I3=I+3
      I6=I+6
      VMD(I)=XM(I)+T02*XM(I3)+T0*XM(I6)
      SMD=SMD+VMD(I)**2
30    VMDERR=VMDERR+(VMD(I)-VMD0(I))**2
      SMD=SQRT(SMD)
      SMDERR=ABS(SMD-SMD0)
      VMDERR=SQRT(VMDERR)
```

```
43.          XMSVER=SQRT((ITRL1*XMSVER**2+VMDERR**2)/ITRL)
44.          XMSSER=SQRT((ITRL1*XMSSER**2+SMDERR**2)/ITRL)
45.          AVGVER=(ITRL1*AVGVER+VMDERR)/ITRL
46.          AVGSER=(ITRL1*AVGSER+SMDERR)/ITRL
47.          VSIGMA=SQRT(ABS(XMSVER**2-AVGVER**2))
48.          SSIGMA=SQRT(ABS(XMSSER**2-AVGSER**2))
49.          WRITE(6,100) VMD,SMD,VMDERR,SMDERR,XMSVER,XMSSER,AVGVER,AVGSER,
50.         -VSIGMA,SSIGMA
51.          WRITE(6,200)
52.          I=VMDERR+1.0
53.          IF(I.GT.20) I=20
54.          IVERR(I)=IVERR(I)+1
55.          RETURN
56.          END
 1.          SUBROUTINE ROOT(C,X,IX,IND)
 2.          DIMENSION C(4),Y(3),Z(3),SY(3),SZ(3),PY(3),PZ(3)
 3.          DIMENSION PPY(3),PPZ(3)
 4.          COMMON /SETO/ DT,GMIN,F,IFLAG,IOPTN,IOPTN1,ISRCH,JUMP,JSWCH
 5.    100   FORMAT(5X,'Z:',3E10.1,5X,'SZ:',3E10.1,5X,'X:',E10.1)
 6.    200   FORMAT(5X,'Y :',3E30.21)
 7.    250   FORMAT(5X,'PPY:',3E30.21)
 8.    300   FORMAT(5X,'PY:',3E30.21)
 9.    400   FORMAT(5X,'SY:',3E30.21)
10.    500   FORMAT(5X,'Z :',3E30.21)
11.    550   FORMAT(5X,'PPZ:',3E30.21)
12.    600   FORMAT(5X,'PZ:',3E30.21)
13.    700   FORMAT(5X,'SZ:',3E30.21)
14.    800   FORMAT(1X,'C :',4E25.15)
15.    900   FORMAT(2I10)
16.    950   FORMAT(/,15X,'NEGATIVE ROOT = ',E12.2)
17.          DATA ITIME/0/
18.          IF(ITIME.EQ.0) READ(5,900) IWRIT
19.          ITIME=1
20.          JSWCH=1
21.          DO 10 I=1,3
22.          Y(I)=0.0
23.          PPY(I)=0.0
24.          PY(I)=0.0
25.          SY(I)=0.0
26.          Z(I)=0.0
27.          PPZ(I)=0.0
28.          PZ(I)=0.0
29.    10    SZ(I)=0.0
30.    1000  X=0.0
31.    2000  ITER=0
32.    3000  ITER=ITER+1
33.          P=C(1)*X**3+C(2)*X**2+C(3)*X+C(4)
34.          DP=3.0*C(1)*X**2+2.0*C(2)*X+C(3)
35.          X=X-P/DP
36.          IF(ITER.LT.IX) GOTO 3000
37.          IF(IND.EQ.0) RETURN
38.          IF(IWRIT.EQ.2) WRITE(6,800) C
39.          IROOT=1
40.          Y(1)=X
41.          A1=C(1)
42.          A2=C(2)+C(1)*X
43.          A3=C(3)+C(2)*X+C(1)*X**2
44.          R=A2**2-4.0*A1*A3
45.          IF(R.LT.0.0) GOTO 5000
46.          IROOT=3
47.          B1=-A2/A1
48.          B2=SQRT(R)/A1
49.          Y(2)=(B1+B2)/2.0
50.          Y(3)=(B1-B2)/2.0
51.    5000  CONTINUE
52.          DO 20 I=1,IROOT
53.          X=Y(I)
54.          PPY(I)=0.25*C(1)*X**4 + (1.0/3.0)*C(2)*X**3 + 0.5*C(3)*X**2 +
55.         + C(4)*X + F/2.0
56.          PY(I)=C(1)*X**3+C(2)*X**2+C(3)*X+C(4)
57.    20    SY(I)=3.0*C(1)*X**2+2.0*C(2)*X+C(3)
58.          IF(IWRIT.LE.1) GOTO 6000
59.          WRITE(6,200) (Y(I),I=1,IROOT)
60.          WRITE(6,250) (PPY(I),I=1,IROOT)
61.          WRITE(6,300) (PY(I),I=1,IROOT)
62.          WRITE(6,400) (SY(I),I=1,IROOT)
63.    6000  CONTINUE
```

```
      DO 30 I=1,IROOT
      ISUB=1
      DO 40 J=1,IROOT
      IF(Y(I).LT.Y(J)) ISUB=ISUB+1
40    CONTINUE
      PPZ(ISUB)=PPY(I)
      PZ(ISUB)=PY(I)
      SZ(ISUB)=SY(I)
30    Z(ISUB)=Y(I)
      IZ=0
      X=0.0
      DO 50 I=1,IROOT
      IF(Z(I).GT.0) IZ=I
50    CONTINUE
      IF(IWRIT.LE.1) GOTO 7000
      WRITE(6,500) (Z(I),I=1,IROOT)
      WRITE(6,550) (PPZ(I),I=1,IROOT)
      WRITE(6,600) (PZ(I),I=1,IROOT)
      WRITE(6,700) (SZ(I),I=1,IROOT)
7000  CONTINUE
      IF(IZ.NE.0) X=Z(IZ)
      IF(IZ.NE.0) JSWCH=1
      IF(JUMP.EQ.0) GOTO 9000
      IF(IROOT.EQ.1) GOTO 9000
      IF(JUMP.EQ.1) GOTO 8000
      IF(IZ.EQ.1.AND.PPZ(1).GT.PPZ(3)) X=Z(3)
      IF(IZ.EQ.1.AND.PPZ(1).GT.PPZ(3)) JSWCH=0
      IF(IZ.EQ.3.AND.PPZ(3).GT.PPZ(1)) X=Z(1)
      IF(IZ.EQ.3.AND.PPZ(3).GT.PPZ(1)) JSWCH=0
      GOTO 9000
8000  CONTINUE
      IF(IZ.EQ.1) X=Z(3)
      IF(IZ.EQ.3) X=Z(1)
      IF(IZ.NE.2) JUMP=0
      IF(IZ.NE.2) ISRCH=1
9000  CONTINUE
      IF(IWRIT.GE.1) WRITE(6,100) Z,SZ,X
      RETURN
      END

      SUBROUTINE PLOT1(IX,NX,ITRL,NQ)
      DIMENSION IX(1),ARRAY(20)
      COMMON /SET4/ XMSVER,XMSSER,AVGVER,AVGSER,VSIGMA,SSIGMA
100   FORMAT(1H1,/,15X,'SAMPLE POPULATION',18X,'MEAN = ',F5.2,5X,'SIGMA
     = ',F5.2,10X,'(FEET)')
200   FORMAT(15X,20I4)
300   FORMAT(15X,20A4)
400   FORMAT(15X,80('='),/,15X,20I4)
500   FORMAT(/,30X,'VECTOR ERROR HISTOGRAM AFTER',I4,' TRIALS')
900   FORMAT(2A4)
      READ(5,900) STAR,BLANK
      WRITE(6,100) AVGVER,VSIGMA
      IXMAX=0
      DO 10 I=1,NX
      IF(IX(I).GT.IXMAX) IXMAX=IX(I)
10    CONTINUE
      IF(IXMAX.LT.NQ) GOTO 1000
      DO 20 I=1,NX
      X=NQ*IX(I)
      X=X/IXMAX+0.5
20    IX(I)=X
1000  CONTINUE
      WRITE(6,200) (IX(I),I=1,NX)
      DO 40 I=1,NQ
      IJ=NQ-I+1
      DO 30 J=1,NX
      ARRAY(J)=BLANK
      IF(IX(J).GE.IJ) ARRAY(J)=STAR
30    CONTINUE
40    WRITE(6,300) ARRAY
      WRITE(6,400) (I,I=1,NX)
      WRITE(6,500) ITRL
      RETURN
      END
```

```
1.00      1.00          0
 ------------------------------------------------------------
 |                                                          |
 |            RT  VMDI  PROCESS  PERFORMANCE  TEST          |
 |                                                          |
 |                      64 DETECTIONS                       |
 |                                                          |
 |----------------------------------------------------------|
 |                                                          |
 |                                                          |
 |   PROGRAM CONTROL PARAMETERS                             |
 |                                                          |
 |     TOPTN            :              0                    |
 |     TSRCH            :              1                    |
 |     JUMP             :              0                    |
 |     TSWCH1           :              1                    |
 |     TSWCH2           :            100                    |
 |     TSTEP            :            100                    |
 |     TTERX            :           2000                    |
 |     TNRX             :             20                    |
 |                                                          |
 |                                                          |
 |   MEASUREMENT ERROR  :          0.000   SEC.  RMS        |
 |                                                          |
 |   NUMBER OF TRIALS   :              1                    |
 |                                                          |
 |----------------------------------------------------------|
 |                                                          |
 |   TEST               : MOTOROLA CASE #1. - 8/19/74       |
 |                                                          |
 |   DRONE              :    BQM 34E/F                      |
 |                                                          |
 |   SIMULATION  BY     :    S. M. DANIEL                   |
 |                           MOTOROLA, INC.                 |
 |                           SCOTTSDALE, ARIZONA 85252      |
 |                           8/20/74                        |
 |                                                          |
 ------------------------------------------------------------
  0          1        200
-----------------------------------------------------------------
                        SCENARIO  DESCRIPTION
-----------------------------------------------------------------


SPECIFICATIONS
--------------
    NO. OF ANTENNAS:          4
    NO. OF GATES   :         16
    BQM 34E/F SPEED:
    MISSILE SPEED  :
    MISS DISTANCE  :
    PHI,THT,THX    :


SYSTEM CONFIGURATION
--------------------
    ANTENNA          POSITION
       1        .00  -16.33      .00
       2       4.67      .00      .00
       3        .00     5.67     3.33
       4      -4.67      .00      .00

    GATES
    1    2    3    4    5    6    7    8    9   10   11   12   13   14   15   16
145.0120.0 95.0 70.0125.0100.0 75.0 50.0145.0120.0 95.0 70.0125.0100.0 75.0 50.0


RELATIVE MISSILE TRAJECTORY PARAMETERS
--------------------------------------
    ACCELERATION   :
    VELOCITY       :
    DISPLACEMENT   :


SCORING ASSIGNMENT
------------------
    MISS VECTOR    :
```

DETECTED RT DATA

| DETECTION | ANTENNA | GATE | TIME |
|---|---|---|---|
| 64 | | | |
| 1 | 1 | 1 | .0015 |
| 2 | 2 | 1 | .0056 |
| 3 | 4 | 1 | .0056 |
| 4 | 1 | 5 | .0067 |
| 5 | 3 | 1 | .0068 |
| 6 | 1 | 2 | .0080 |
| 7 | 2 | 5 | .0108 |
| 8 | 4 | 5 | .0108 |
| 9 | 3 | 5 | .0119 |
| 10 | 2 | 2 | .0121 |
| 11 | 4 | 2 | .0121 |
| 12 | 3 | 2 | .0132 |
| 13 | 1 | 6 | .0132 |
| 14 | 1 | 3 | .0146 |
| 15 | 2 | 6 | .0173 |
| 16 | 4 | 6 | .0173 |
| 17 | 3 | 6 | .0184 |
| 18 | 2 | 3 | .0187 |
| 19 | 4 | 3 | .0187 |
| 20 | 3 | 3 | .0198 |
| 21 | 1 | 7 | .0201 |
| 22 | 1 | 4 | .0215 |
| 23 | 2 | 7 | .0242 |
| 24 | 4 | 7 | .0242 |
| 25 | 3 | 7 | .0252 |
| 26 | 2 | 4 | .0256 |
| 27 | 4 | 4 | .0256 |
| 28 | 3 | 4 | .0265 |
| 29 | 1 | 8 | .0277 |
| 30 | 2 | 8 | .0319 |
| 31 | 4 | 8 | .0319 |
| 32 | 3 | 8 | .0325 |
| 33 | 1 | 16 | .0456 |
| 34 | 2 | 16 | .0496 |
| 35 | 4 | 16 | .0496 |
| 36 | 1 | 12 | .0518 |
| 37 | 3 | 16 | .0518 |
| 38 | 1 | 15 | .0532 |
| 39 | 2 | 12 | .0558 |
| 40 | 4 | 12 | .0558 |
| 41 | 2 | 15 | .0573 |
| 42 | 4 | 15 | .0573 |
| 43 | 3 | 12 | .0578 |
| 44 | 1 | 11 | .0587 |
| 45 | 3 | 15 | .0591 |
| 46 | 1 | 14 | .0601 |
| 47 | 2 | 11 | .0628 |
| 48 | 4 | 11 | .0628 |
| 49 | 2 | 14 | .0641 |
| 50 | 4 | 14 | .0641 |
| 51 | 3 | 11 | .0645 |
| 52 | 1 | 10 | .0653 |
| 53 | 3 | 14 | .0659 |
| 54 | 1 | 13 | .0667 |
| 55 | 2 | 10 | .0694 |
| 56 | 4 | 10 | .0694 |
| 57 | 2 | 13 | .0707 |
| 58 | 4 | 13 | .0707 |
| 59 | 3 | 10 | .0711 |
| 60 | 1 | 9 | .0718 |
| 61 | 3 | 13 | .0724 |
| 62 | 2 | 9 | .0759 |
| 63 | 4 | 9 | .0759 |
| 64 | 3 | 9 | .0775 |

MOTO

While the foregoing description of the preferred embodiment of the invention discloses a scenario in which the miss distance of a missile with respect to a moving airborne target is measured, it will be apparent to one skilled in the art that there may be other applications for the invention. Since the system, as described, computes a trajectory with respect to the "target", it is of no consequence to the invention if the "target" is not moving. The components of the system of the invention, as herein described as mounted on a "target", could as well be mounted on a ground or water based mobile vehicle or on such a vehicle in a fixed location or at a fixed (nonmobile) ground based station. The system may be used to accurately record the trajectory of any moving vehicle as well as the missile heretofore described.

Various other modifications and changes may be made to the present invention from the principles of the invention described above without departing from the spirit and scope thereof, as encompassed in the accompanying claims.

What is claimed is:

1. A system for measuring the minimum miss distance vector of a missile from a target comprising:

a plurality of sensor means mounted on the target in predetermined locations for sensing ranges to the missile, said sensor means producing range data;

synchronize means for sequentially operating said sensor means, for converting said sensed ranges to a digital form, and for associating with said digital data additional digital data identifying from which of said plurality of sensor means the digital range data is derived;

means for transmitting said range data and said identifying data corresponding to said range data; and data processing means for receiving and processing said range data and for associating with said range data additional corresponding time and predetermined data corresponding to said sensor means locations according to a predetermined nonlinear algorithm to provide the desired missile trajectory and vector miss distance information.

2. The apparatus of claim 1 wherein said nonlinear algorithm is of the type known as a "one-step conjugate directions".

3. The apparatus of claim 1 wherein said nonlinear algorithm is of the type known as a "steepest descent".

4. The apparatus of claim 1 wherein said nonlinear algorithm is of the type known as an "N-step conjugate directions".

5. The apparatus of claim 4 wherein said "N-step conjugate directions" algorithm comprises an initially predetermined number of steps which number is subsequently and adaptively modified by said data processing operation.

6. A method of determining the minimum miss distance vector of a missile with respect to a target comprising the steps of:

measuring ranges from the target to the missile utilizing a plurality of sequentially operated radar pulses, said radar pulses being emitted from an equal plurality of space diverse antennas mounted on the target in predetermined locations;

synchronizing said radar pulses to assure that a reflective return signal from the missile may be received as a result of any given pulse being emitted before a succeeding pulse of said plurality of pulses is emitted;

digitizing the return signals from the missile to provide digital range data;

associating corresponding digital sensor code data with said range data;

transmitting said corresponding range and sensor code data to a data processor;

providing time data corresponding to said range data;

supplying predetermined antenna location data in digital form; and calculating a trajectory of the missile from said range, and time identifying and locational data utilizing a nonlinear algorithm.

7. The method according to claim 6 wherein said nonlinear algorithm is of the type know as "one-step conjugate directions".

8. The method according to claim 6 wherein said nonlinear algorithm is of the type known as "steepest descent".

9. The method according to claim 6 wherein said nonlinear algorithm is of the type known as "N-step conjugate directions. "

10. The method according to claim 9 wherein said "N-step conjugate directions" algorithm comprises an initially predetermined number of steps, said number of steps being subsequently and adaptively modified by said calculating step.

11. A system for measuring and reproducing the relative trajectory of a vehicle comprising:

a plurality of sensor means mounted in predetermined space diverse positions, said sensor means producing range data;

synchronizer means for sequentially operating said sensor means, for converting said sensed ranges to a digital form, and for associating with said digital sensed ranges additional digital data identifying from which of said plurality of sensor means the digital range data is derived;

means for transmitting said range data and said identifying data corresponding to said range data; and data processing means for receiving and processing said transmitted range data and associating corresponding time and said sensor positional data according to a predetermined nonlinear algorithm to provide the desired vehicle trajectory.

12. The apparatus of claim 11 wherein said nonlinear algorithm is of the type known as a "one-step conjugate directions".

13. The apparatus of claim 11 wherein said nonlinear algorithm is of the type known as a "steepest descent".

14. The apparatus of claim 11 wherein said nonlinear algorithm is of the type known as an "N-step conjugate directions".

15. The apparatus of claim 14 wherein said "N-step conjugate directions" method comprises an initially predetermined number of steps which number is subsequently and adaptively modified by said data processing operation.

16. A method of determining the relative trajectory of a vehicle comprising the steps of:

measuring ranges to the vehicle utilizing a plurality of sequentially operated radar pulses, said radar pulses being emitted from an equal plurality of space diverse antennas located in predetermined positions;

synchronizing said radar pulses to assure that a reflective return signal from the missile may be received as a result of any given pulse being emitted before a succeeding pulse of said plurality of pulses is emitted;

digitizing the return signals from the vehicle to provide digital range data;

providing corresponding digital sensor identifying codes to said digital range data;

transmitting said corresponding range and identifying data to a data processor;

providing time data corresponding to said range data;

supplying digital location data corresponding to said predetermined antenna positions; and calculating a trajectory of the vehicle from said range, time, identifying and locational data utilizing a nonlinear algorithm.

17. The method according to claim 16 wherein said nonlinear algorithm is of the type know as "one-step conjugate directions".

18. The method according to claim 16 wherein said nonlinear algorithm is of the type known as "steepest descent".

19. The method according to claim 16 wherein said nonlinear algorithm is of the type known as "N-step conjugate directions".

20. The method according to claim 19 wherein said "N-step conjugate directions" algorithm comprises an initially predetermined number of steps, said number of steps being subsequently and adaptively modified by said calculating step.

* * * * *